United States Patent [19]

Prest, Jr.

[11] Patent Number: 4,832,374

[45] Date of Patent: May 23, 1989

[54] SYSTEM FOR INDEXING TEXTUAL MATERIAL

[76] Inventor: Kenneth W. Prest, Jr., 2451 Oakdale St., Tallahassee, Fla. 32312

[21] Appl. No.: 97,416

[22] Filed: Sep. 15, 1987

Related U.S. Application Data

[63] Continuation of Ser. No. 641,178, Aug. 15, 1986, abandoned.

[51] Int. Cl.[4] ..... B42E 21/00

[52] U.S. Cl. ..... 283/38; 283/36; 283/37; 283/42

[58] Field of Search ..... 283/35–42; 412/78

[56] References Cited

U.S. PATENT DOCUMENTS

| | | | |
|---|---|---|---|
| 752,385 | 6/1941 | Dunbar | 283/37 |
| 1,183,779 | 5/1916 | Thacker | 283/36 X |
| 3,008,582 | 11/1961 | Kent | 283/36 |
| 3,805,426 | 4/1974 | Cunningham | 283/39 X |
| 4,516,871 | 5/1985 | Leitman | 283/40 X |

FOREIGN PATENT DOCUMENTS

| | | | |
|---|---|---|---|
| 0818190 | 10/1951 | Fed. Rep. of Germany | 283/42 |
| 0677186 | 3/1930 | France | 283/38 |
| 0183221 | 9/1936 | Switzerland | 283/36 |
| 0752509 | 7/1956 | United Kingdom | 283/42 |

*Primary Examiner*—P. W. Echols
*Assistant Examiner*—Taylor J. Ross
*Attorney, Agent, or Firm*—Millen & White

[57] ABSTRACT

A system for indexing releasably bound numerically categorized textual material provides a high degree of convenience. A plurality of dividers is provided each of which corresponds to and separates alpha numerical categories and each divider has a tab associated therewith. Each tab includes means for displaying indicia which include at least the last digit of the respective alpha numerical category. The releasably bound assembly of textual material has an edge-face portion which is divided into a number of fields equal to the number of possible last character of alpha numerical categories. Each field corresponds to the last character of a numerical category and contains a bank of tabs arranged sequentially in superposed relationship. Each tab in a respective bank of tabs has the same last character, e.g., digit. The system provides for frequent revision, such as removal of some categories and addition of other categories along with the respective dividers and associated tabs while maintaining the same high degree of order and convenience, even after extensive revision.

4 Claims, 2 Drawing Sheets

SYSTEM FOR INDEXING TEXTUAL MATERIAL

This application is a continuation of application Ser. No. 641,178 filed Aug. 15, 1986 now abandoned.

BACKGROUND OF THE INVENTION

This invention relates to indexing systems for text material.

Textual material, such as government statutes and regulations, is frequently organized by "logical" categories of related subject matter and numerically subdivided. For example, a body of regulations may be organized and numbered in categories corresponding to the individual executive agencies of the government and each of these numerically subdivided according to the specific subject jurisdictions or applications the agency is authorized to administer. When information, such as statutes and regulations, changes frequently and is widely and frequently consulted, it becomes desirable to provide means for indexing the various categories and subcategories so that the information in any particular category or subcategory may be more readily available and easily accessible. When a body of information, such as regulations, in printed form is releasably bound, such as in a loose-leaf binder, indexing is frequently accomplished by providing tabbed dividers between categories. These serve to separate and distinguish the categories and make it easier and quicker for a user of the collection of information to open the bound material to the category of interest. It is common practice to locate the tabs of each divider in such a fashion that they present a staggered array along the outer edge of a page of print. Typically, this staggered array of tabs is in no special order nor are the tabs within the array of special dimension.

Given these circumstances, when the assembly of material contains a large number of categories or subcategories or when the categories or subcategories are frequently changed, as by deletion of some categories and addition of others, disorder of the array is created and the benefits of logical tabbing are lost or greatly diminished. For example, when it is desired to insert a new tabbed category of similarly aligned information into the middle of a body of existing material which previously had been tabbed in a fixed array, the tab location necessarily must be arbitrary. Thus a tab position results which does not conform with the previously established order of the array and thus misrepresents the relative position and significance of the new category of material in the context of the other preexisting categories. When this is repeated as a consequence of frequent changes, the logic of the total organization of the assembly of information is lost and the disarray creates confusion and difficulty in any search for information within the assembly. To preclude this situation, the organizer of the material must periodically realign and remake the index tab system at great cost to the producer and at considerable inconvenience to the user.

U.S. Re. Pat. Nos. 12,446; 675,909; 790,002; 1,084,449; 1,294,043 and 1,824,659 are representative of prior art indexing systems for indexing releasably bound assemblies of textual material. Such systems provide means for accessing textual material organized in hierarchical fashion. In such systems, however, it is not possible to change by adding or deleting categories of material in the central portion of the assembly without disturbing the order of the system.

SUMMARY CF THE INVENTION

It is an object of this invention to provide an indexing system for an assembly of categorized textual material which possesses a higher degree of order, integrity, continuity and user convenience than indexing systems of the prior art.

A further object of this invention is to provide an indexing system for an assembly of releasably bound textual material which maintains the originally designated high degree of order while enabling revisions to the information assembly.

A still further object of the invention is to provide an indexing system for an assembly of categorized textual material wherein categories and the tabbed dividers for the categories can be easily and quickly removed from the assembly without affecting the order or integrity of the assembly as a whole.

A still further object of the invention is to provide an indexing system for an assembly of categorized textual material wherein categories and the tabbed dividers for the categories can be easily and quickly added into the assembly without affecting the order or integrity of the assembly as a whole.

A still further object of the invention is to provide an indexing system for an assembly of categorized textual material wherein an additional hierarchical arrangement of selected subcategories can be created while preserving the dominant relationships of the original categories.

Upon further study of the specification and appended claims, further objects and advantages of this invention will become apparent to those skilled in the art.

These and other objects of the invention have been attained by providing a system for indexing an assembly of releasably bound alphanumerically titled and categorized textual material wherein the assembly presents at least one peripheral, edge-face portion and includes a plurality of dividers each of which have a tab associated therewith and correspond to and separate the categories. Each tab includes means for displaying indicia which include at least the last character (e.g., digit) of the respective alphanumerical category. The length of the edge-face portion is divided into a number of fields which is equal to the number of possible last characters and each field corresponds to the last character of an alphanumerical category, usually a number. Each field contains a bank of tabs arranged sequentially in superposed relationship and each tab in a respective bank of tabs has the same last character. For example, the base of the numbering system in common use is 10.

Therefore, the number of tabs in a bank titled with indicia using only numbers from the base 10 system is 10. The position of each tab in the bank is assigned a fixed number 1 through 0, in this case, and the alphanumeric title of a category is printed on the tab whose assigned position in the bank corresponds with the last digit of the alphanumeric title. Hierarchically arranged subcategories can follow this same position sequence, but preferably employ a tab of smaller height to differentiate their relative subordinate values.

BRIEF DISCUSSION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein:

FIGS. 1 and 3 are perspective views of the indexing means in conjunction with an assembly of releasably bound numerically titled categories of text material;

and

DETAILED DISCUSSION

Figure 1:
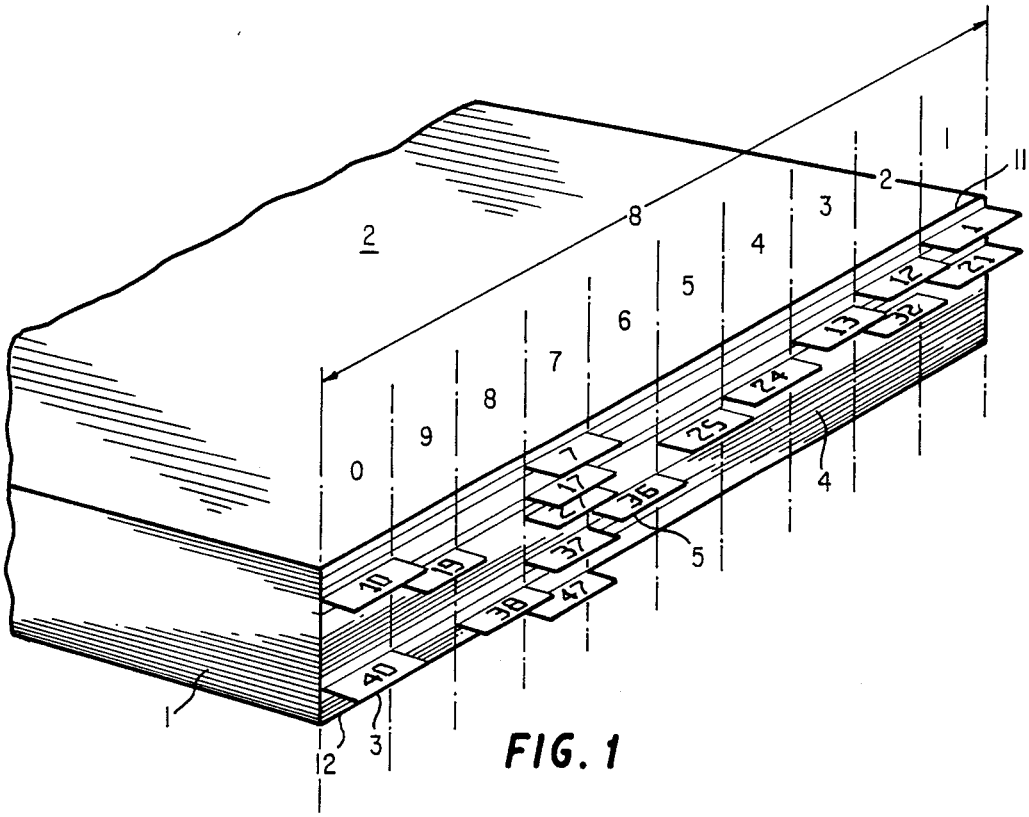

Referring now to FIG. 1, there is shown in a particularly advantageous embodiment an assembly of releasably bound numerically titled, tabbed and categorized textual material 1. The assembly includes a top face, 2, a bottom face, 3, a top edge 11, a bottom edge 12, and a peripheral edge face, 4. The textual material is subdivided into categories and each category has associated therewith a divider for separating and distinguishing the individual categories. Each divider has a tab, 5, which protrudes beyond the peripheral face of the assembly a given distance, so that each category can be readily recognized and easily accessed. The length of the edge-face 8, is divided equally into 10 position fields corresponding to the numbers in the commonly used base 10 numbering system. Each position-field is assigned a single number 1, 2, 3, 4, 5, 6, 7, 8, 9, or 0. Numbering preferably begins with "1" at one end of the edge-face and ends with "0" at the other end. In a particularly advantageous embodiment, the numbering begins at "1" at the field closest to the top edge of the assembly and ends with "0" at the field closest to the bottom edge of the assembly. The position of any tab along the length of the edge-face is thus predetermined and fixed relative to other tabs.

If each category of text is alphanumerically titled and each title number ends with a single digit, 1 through 0, the text of that category is systematically filed behind the divider whose tab is printed with the particular title number and located to protrude from the peripheral face of the assembly in the position-field corresponding to the assigned number of that position-field. Thus, all titles ending with the number 1 will be printed on tabs protruding from the dividers in position-field "1"; those ending with the number 7 tabs in position-field "7"; and those with the number 0 on tabs in position-field "0". Each category tab, consequently, has a predetermined, precise and fixed location along the length of the edge-face position.

According to the magnitude of the title number, i.e., 7, 17, 27, 37, 47, the tabbed dividers are superposed in arrangement in the assembly within the position-field in sequential order, regardless of the continuity of the sequence, and range between the top edge-face and the bottom face. Thus, the tabs can be arranged in ascending order in progression away from the top face of the assembly or they can be arranged in descending order in progression away from the top face of the assembly. For any particular tab corresponding to any particular numerical category there is always a precise location, i.e., field along the length of the peripheral edge-face of the assembly, and there is always a sequential location for each tab within a particular field. For any particular alphanumeric title, a divider and tab can be constructed with a precise and logical location relative to other categories and to the assembly as a whole. The result is a highly ordered indexing system in which the order is established and readily maintained even after revisions (additions or deletions) are made to the assembly of textual material.

A given category of information can be readily accessed by determining the number of the last digit of the title of the category and identifying the position-field which corresponds to this last digit. Once the field is located, the tab within that position-field which corresponds to the desired category can be readily located according to the sequential order of the tabs. The divider is then conventionally used to open the assembly of material to the desired category. If the numbering of the position-fields being as earlier described with the number "1" in the upper right corner of the assembly and descends along the edge-face to the number "0" in the lower right corner of the assembly and the length of the edge-face conceptually divided into thirds, the search for a particular title can be quickly focused, since numbers 1–3 will always be located in the upper third, numbers 4–7 in the middle and numbers 8–0 in the lower third. For example, to access a category with a title number 42, one would focus the search in the upper third range and locate the position-field 2; then scan forward (from top to bottom edge) in sequence in this position-field until the tab marked 42 is identified. The assembly of textual material following this divider could then be opened to reveal category 42.

Figure 3:
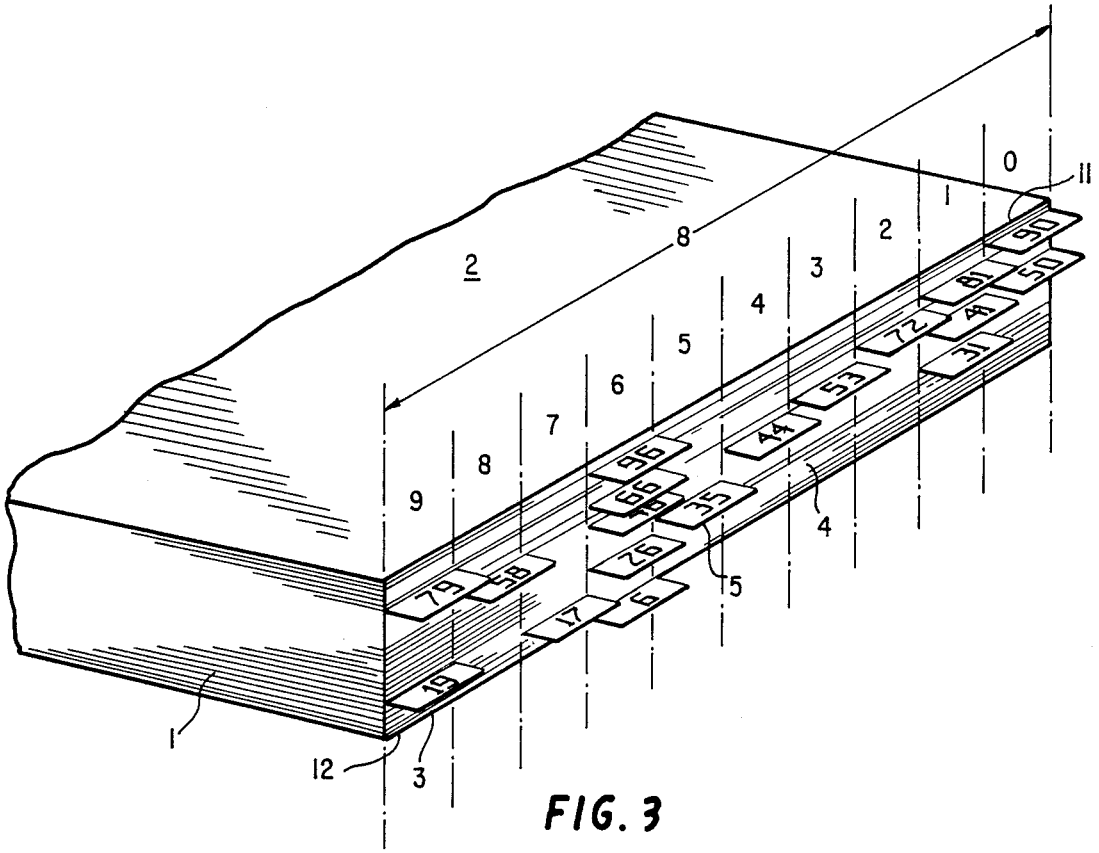
FIG. 3 is a perspective view of another embodiment of the invention wherein the "O" field is at the beginning rather than the end of the position fields.

FIG. 3 is identical to FIG. 1 except that the "O" position-field precedes the "1" digit rather than following the "9" digit.

An assembly of releasably bound alphanumerically categorized material which is indexed in accordance with the present invention can be readily revised without disturbing the order or integrity of the indexed assembly. Any category may be readily deleted simply by removing the text and tabbed divider or new categories inserted by adding text and an accompanying tabbed divider. The assembly as altered will continue to reflect the same order of textual material and the same sequential locations of access tabs.

To remove a category of text, the particular text and accompanying tab are removed from the assembly and, if appropriate, references to this material are removed from accompanying tables of contents and subject indexes. The removal of the material does not affect the remaining portions of the assembly.

When a new category is to be inserted, the location in the assembly is determined by the last character in the alphanumerical title of the text which corresponds to the character of the position-field. The full alphanumerical title of the category determines the sequential location of the text and tab in the position-field and thus its location in the body of the assembly. The insertion is most easily accomplished by first identifying the biggest title number in the selected position-field which immediately precedes the number of the title to be inserted. The assembly is then opened and the new material is inserted following the last page of the text of the existing material. Thus, to insert a new category 27 into an assembly which already contains categories numbered 7, 17, 37 and 47, the assembly is opened at category 17, the last page of the text of category 17 is turned and the new category 27 and its accompanying tabbed divider are inserted into the assembly. The result is that tab 27 now has a location in position-field 7 sequentially between tab 17 and 37. Similar operations may be carried out repeatedly without disturbing the overall order of the various categories.

Figure 2:
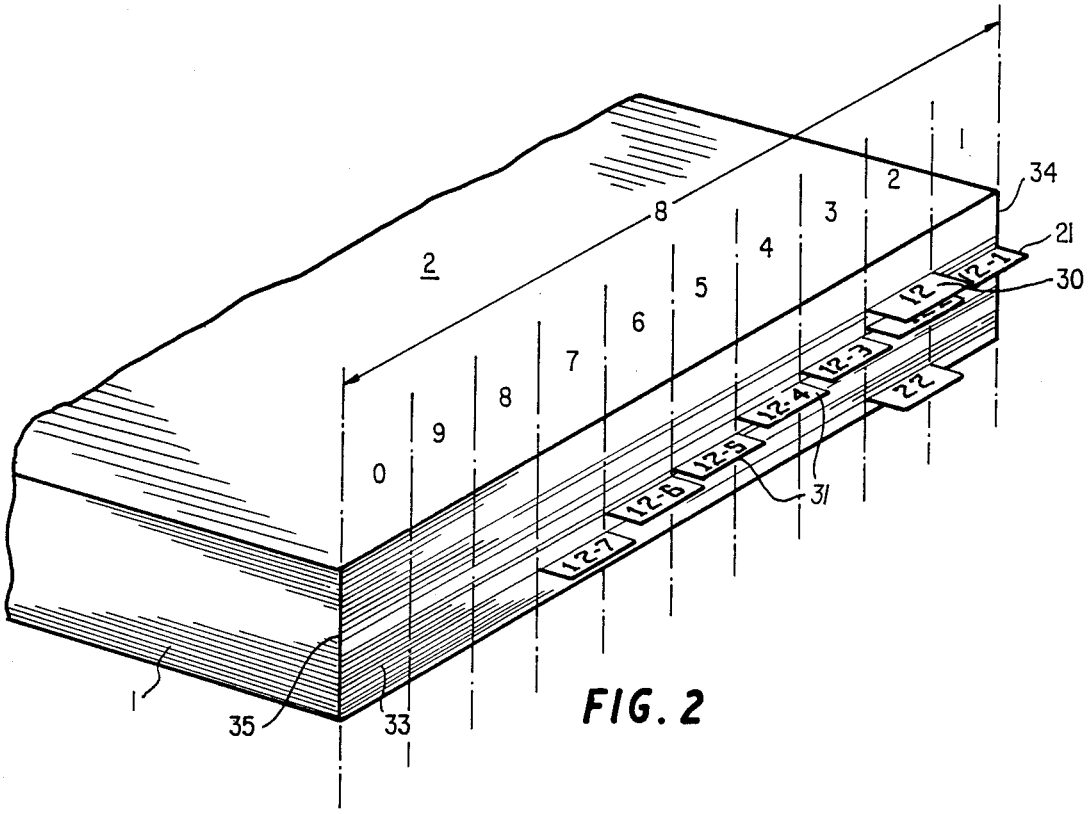
FIG. 2 is a perspective view of an ass of text material corresponding to one numerically titled category with subcategories and the dividers and tabs which correspond to and separate that category and its subcategories.

Categories of text may be equally conveniently and effectively subdivided as shown in FIG. 2. Such a subdivision includes the tabbed category divider, 21, which bears the title number "12" of the major category, illustrated by the primary tab 30, and is inserted in the assembly as described above and a plurality of subdividers, 22, each corresponding to a particular subcategory. Each subdivider is provided with an associated secondary tab, 31, which bears indicia corresponding to the title identifier of the subcategory, "12-1," "12-2," "12-3," etc., and has an area less than that of the primary tab 30. The tabbed subdividers may or may not employ the indexing system discussed above. As is seen in FIG. 2, each of the secondary tabs 31 and the primary tab 30 project beyond the side edge face 33 of the system 1 when the assembly is closed. In the arrangement of FIG. 2, as well as the arrangement of FIG. 1, the digits 1–9, O ascend from the upper corner 34 of the side edge face 33 of the assembly 1 to the lower corner 35 thereof. The choice of whether to employ the predetermined position-field system for subcategories would be based on the anticipated requirements for accessibility and the need for and frequency of expected change in the text of the subcategories. If little or no change is expected in the subdivided categories but access is desired to be enhanced, subdivider tabs may be located arbitrarily or in the same position-field as the major category tabbed divider, but of a smaller height (protruding from the peripheral face less than the height of the major tabs to reflect a subordinate nature) may be used. When change is most likely or anticipated and ready access to each subdivision is required, the position-field ordering system may be used in conjunction with a diminutive tab size.

The invention is particularly useful for indexing government statutes and regulations which are most frequently organized by numerical category, are subject to frequent revision and need to be filed and indexed in a manner to facilitate frequent and repetitive referencing. For example, typically, regulations are categorized numerically using a decimal system according to the administering government agency (e.g., 17), the subject matter jurisdictions (e.g., Chapters 17-3, 17-4, 17-5, 17-15, 17-17, etc.) and the particular details for implementation typically divided into numerical sections, subsections, etc. in a hierarchical manner, e.g., 17-17.501(1). Consequently, the body of information pertaining to the legal responsibilities of an agency lends itself readily to ordering and filing by the present invention.

For purposes of clarity the invention has been illustrated as applied to regulations which are titled and classified by composite numbers, but it will be recognized by those skilled in the art that the invention could be applied to identification systems comprising various alphanumeric title characters and/or other varied base number systems.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A system for indexing an assembly of releasably bound textual material divided into categories and subcategories, the assembly including a top face, bottom face and a side edge face which is defined by a top edge and a bottom edge and extends from an upper corner to a lower corner of the side edge face, the system comprising:

indicia associated with each category and subcategory for titling the categories and subcategories with a categorical number and a field number, wherein the field number includes at least one digit which is "0" or an integer in the range of "1" to "9", the field number being the last number associated with the category or subcategory;

category and subcategory dividers, all being substantially the same width and length, each of which corresponds to and marks the beginning or end of a category or a subcategory;

single primary tabs each attached to a category divider at the beginning of a category, each primary tab displaying to least the last digit of the respective category so as to provide a field number, each primary tab having a selected area and projecting from the side edge face of the assembly when the assembly is closed so as to be visible when the assembly is closed;

single secondary tabs attached to each subcategory divider at the beginning of a subcategory, each secondary tab displaying at least the last digit of a field number and having a selected area substantially less than that of a primary tab and each secondary tab projecting beyond the side edge face of the assembly when the assembly is closed so as to be visible when the assembly is closed;

wherein the length of the edge-face portion is divided into ten non-overlapping fields equal to the number of possible digits, and each field corresponds in a one-to-one correspondence to one of said digits;

wherein each tab is located in the field which corresponds to its last digit;

wherein at least one field contains a plurality of category and subcategory tabs, and all fields containing a plurality of said tabs have said tabs arranged sequentially is superposed relationship, and wherein the numbers on the tabs in each field are arranged in ascending order beginning from the top face of the assembly and moving toward the bottom face of the assembly;

whereby the total number of tabs between the first tab in the first field and last tab in the last field is not limited by the number of categories in the system, allowing the system to easily expand and contract as categories and subcategories are added and deleted, thus providing a flexible system which maintains its convenience over time.

2. The system of claim 1, wherein the field numbers are organized with the digit "0" positioned after the digit "9", the digit "0" representing the number "10" and providing a field for numbers which are a multiple of "10".

3. The system of claim 1, wherein the field numbers start from the upper corner of the side edge face of assembly and ascend toward the lower corner of the side edge face of the assembly.

4. A system for indexing government regulations or statutes arranged in an assembly of releasably bound textual material divided into categories and subcategories, the assembly including a top face, bottom face and a side edge face which is defined by a top edge and a bottom edge and extends from an upper corner to a lower corner of the side edge face, the system comprising:

indicia associated with each category and subcategory for titling the categories and subcategories with a categorical number and a field number, wherein the field number includes at least one digit which is "0" or an integer in the range of "1" to "9", the field number being the last number associated with the category or subcategory; the field numbers being organized with the digit "0" positioned after the digit "9" so that the digit "0" represents the number "10", thereby providing a number field for numbers which are a multiple of the number "10"; the field numbers being arranged to start from the upper corner of the side edge face of the assembly and ascending toward the lower corner of the side edge face of the assembly;

category and subcategory divides, all being substantially the same width and length, each of which corresponds to and marks the beginning or end of a category or a subcategory;

single primary tabs each attached to a category divider at the beginning of a category, each primary tab displaying at least the last digit of the respective category so as to provide a field number, each primary tab having a selected area and projecting from the side edge face of the assembly when the assembly is closed so as to be visible when the assembly is closed;

single secondary tabs attached to each subcategory divider at the beginning of a subcategory, each secondary tab displaying at least the last digit of a field number and having a selected area substantially less than that of a primary tab and each secondary tab projecting beyond the side edge face of the assembly when the assembly is closed so as to be visible when the assembly is closed;

wherein the length of the edge-face portion is divided into ten non-overlapping fields equal to the number of possible digits, and each field corresponds in a one-to-one correspondence to one of said digits;

wherein each tab is located in the field which corresponds to its last digit;

wherein at least one field contains a plurality of category and subcategory tabs, and all fields containing a plurality of said tabs have said tabs arranged sequentially is superposed relationship, and wherein the numbers on the tabs in each field are arranged in ascending order beginning from the top face of the assembly and moving toward the bottom face of the assembly;

whereby the total number of tabs between the first tab in the first field and last tab in the last field is not limited by the number of categories in the system, allowing the system to easily expand and contract as categories and subcategories are added and deleted, thus providing a flexible system which maintains its convenience over time.

* * * * *

UNITED STATES PATENT AND TRADEMARK OFFICE

CERTIFICATE OF CORRECTION

PATENT NO. : 4,832,374

DATED : May 23, 1989

INVENTOR(S) : Kenneth Prest, Jr.

It is certified that error appears in the above-identified patent and that said Letters Patent is hereby corrected as shown below:

Title page, Related U.S. Application Data: reads "Continuation of Ser. No. 641,178, Aug. 15, 1986, Aban-"

Should read -- Continuation of Ser. No.641,178, Aug. 15, 1984, Aban-

Signed and Sealed this

Tenth Day of October, 1989

*Attest:*

DONALD J. QUIGG

*Attesting Officer*

*Commissioner of Patents and Trademarks*